United States Patent [19]

Kursfeld

[11] Patent Number: 4,787,437

[45] Date of Patent: Nov. 29, 1988

[54] METHOD FOR STARTING A CONTINUOUS CASTING PLANT

[75] Inventor: Armin Kursfeld, Cham, Switzerland

[73] Assignee: Stopinc Aktiengesellschaft, Baar, Switzerland

[21] Appl. No.: 24,789

[22] Filed: Mar. 11, 1987

[30] Foreign Application Priority Data

Mar. 14, 1986 [DE] Fed. Rep. of Germany ..... 3608503

[51] Int. Cl.[4] ..... B22D 11/18

[52] U.S. Cl. ..... 164/453; 164/449; 164/483

[58] Field of Search ..... 164/483, 453, 449

[56] References Cited

U.S. PATENT DOCUMENTS

| | | | |
|---|---|---|---|
| 4,077,457 | 3/1978 | Hashio et al. | 164/453 |
| 4,570,230 | 2/1986 | Wilson et al. | 164/449 X |
| 4,573,128 | 2/1986 | Mazur | 164/449 X |
| 4,583,717 | 4/1986 | Hasegawa et al. | 164/453 X |
| 4,597,048 | 6/1986 | Mazur et al. | 164/449 X |
| 4,625,787 | 12/1986 | Haveman et al. | 164/453 |

FOREIGN PATENT DOCUMENTS

| | | | |
|---|---|---|---|
| 0063285 | 10/1982 | European Pat. Off. | 164/449 |
| 55-122659 | 9/1980 | Japan | 164/453 |
| 55-149758 | 11/1980 | Japan | 164/449 |
| 59-46705 | 11/1984 | Japan | 164/453 |
| 2160458A | 12/1985 | United Kingdom | 164/453 |
| 2172532A | 9/1986 | United Kingdom | 164/483 |

*Primary Examiner*—Nicholas P. Godici
*Assistant Examiner*—J. Reed Batten, Jr.
*Attorney, Agent, or Firm*—Wenderoth, Lind & Ponack

[57] ABSTRACT

For the automatic casting start-up of a strand in continuous casting installations, a programmed start-of-casting curve is started with a slightly throttled sliding gate valve and each partial real time of the rising actual metal level is compared with the corresponding partial characteristic time during time ranges stored for each of the partial characteristic times wherein each of the individual ranges corresponding to a flow position of the valve, and the flow position of the time range into which the measured partial real time falls is set automatically. In this way, a preassigned start-of-casting curve can be optimally reproduced.

24 Claims, 2 Drawing Sheets

METHOD FOR STARTING A CONTINUOUS CASTING PLANT

BACKGROUND OF THE INVENTION

The invention relates to a method for the automatic casting start-up of a strand in continuous casting installations, more particularly with molten steel flowing through a controllable sliding gate valve of a tundish into an empty mold above the starting rod, the rising actual metal level in said mold being guided along a fixed start-of-casting curve with characteristic times predetermined between metal-level distances and is controlled to reach a desired metal level adhered to by means of measuring and controlling devices during the pouring operation, causing the strand-pulling to be triggered.

Such a method is exemplified in West German Pat. No. 32 21 708, according to which the start of casting begins with an intermittent phase during which the valve is closed repeatedly in order to allow motions in the metal level rising in the mold to decay and thereby to bring about the conditions for accurately measuring the actual metal level. The intermittent phase is followed by a continuous filling phase, which is controlled by regulating the rising actual metal level by means of a linear controller as a function of a programmed start of casting curve.

SUMMARY OF THE INVENTION

The major object of the present invention is to reproduce dependably and with simple process steps the desired values of a preselected continuous start-of-casting curve in accordance with the disclosed start-of-casting method during the filling of the continuous casting mold.

According to the present invention, this object is achieved essentially by comparing, during the start of casting beginning with a throttled sliding gate valve, each partial real time of the rising actual metal level measured within a filling distance with time ranges stored for each of the partial characteristic times, to each of which is assigned a flow position of the valve which, after comparison, is moved to the flow position of each time range into which the measured partial real time falls. In this way, a preassigned start-of-casting curve can be dependably adhered to with relatively few flow positions of the valve, i.e., with a minimum of strain, especially of the mechanism actuating the valve and its controls. Furthermore, by positively determining the number, but preferably the length, of the individual filling distances and of the corresponding partial characteristic times, the start-of-casting curve or the filling rate of the mold can, as much as possible, be adapted to the needs of a continuous casting installation for the start-of-casting process. This, in turn, produces a pouring stream which, on the one hand, keeps the flow area of the valve free of frozen metal and, on the other, ensures a pull-resistant strand formation.

Also, the start of casting of small cross-sectional shapes in which the start-of-casting time is usually 8 seconds, can be controlled without difficulty if, preferably, the programmed start-of-casting curve is monitored on at least one filling distance.

More particularly, with regard to the time ranges assigned to the partial characteristic times, the present invention proposes that each partial characteristic time applicable to a filling distance have at least three time ranges with different flow positions of the valve and that a partial characteristic time lasting two seconds and valve positions bound thereto be provided. These proposals have proven extremely expedient.

It has also been proven expedient if the throttled nozzle position of the valve is set at a value which is between 40 and 90% of the full opening of the valve.

BRIEF DESCRIPTION OF THE DRAWINGS

The invention will now be described with reference to a practical embodiment, reference being had to the accompanying drawings.

DESCRIPTION OF THE PREFERRED EMBODIMENT

Figure 1:
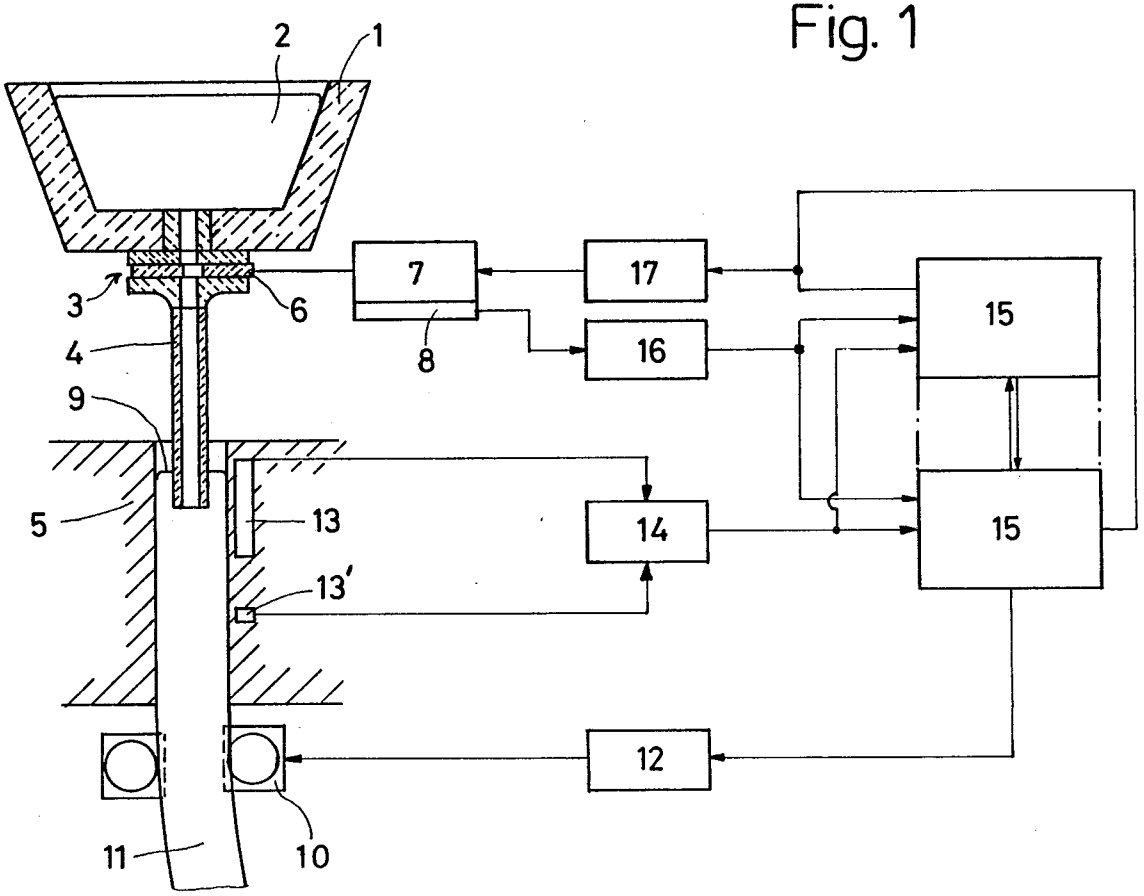
FIG. 1 is a diagrammatic representation of a continuous casting installation.

FIG. 1 shows a tundish 1, from which the stream of molten metal flowing into a mold 5 can be controlled by a sliding gate valve 3 and a casting tube 4 connected thereto. To this end, sliding plate 6 of the gate valve 3 is coupled mechanically to an actuator 7 which is coupled to a position detector 8 detects the particular operating position of the valve. The continuous casting mold 5, into which the free end of casting tube 4 is inserted, has a desired metal level 9 which is to be adhered to during the normal pouring operation. This desired metal level 9 can be kept constant on the other hand by regulating the inflowing amount of metal by means of the sliding gate valve 3 or by varying the pulling rate of the cast strand by switching on a strand-pulling mechanism 10.

For this practical embodiment, a constant strand-pulling rate is fixed during the casting operation, the start of the strand-pulling mechanism being triggered by a switch 12 as soon as the metal level rising in the empty mold 5 during the start of a casting operation has reached a predetermined actual metal level.

If the pulling rate of the cast strand 11 is constant, the desired metal level 9 in the mold 5 is controlled solely from the inlet side, i.e., by means of the sliding gate valve 3, which, toward that end, is coupled to an automatic control system with an electronic measuring data processor. This control system has a metal-level detector 14 which is fed signals from sensors 13 and 13', said metal-level detector 14 transmitting signals to a processor 15, to which are also routed the signals of a position detector 16 which is fed signals by the position sensor 8. In processor 15, the signals are evaluated and appropriate commands are sent to a controller 17 of the actuator 7 and to switch 12 of the strand-pulling mechanism 10.

Figure 2:
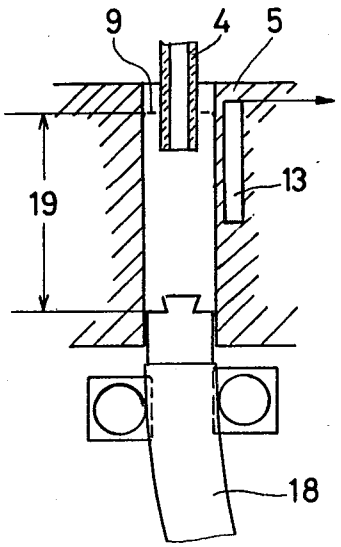
FIG. 2 shows the mold depicted in FIG. 1 prior to the start of casting.
Figure 3:
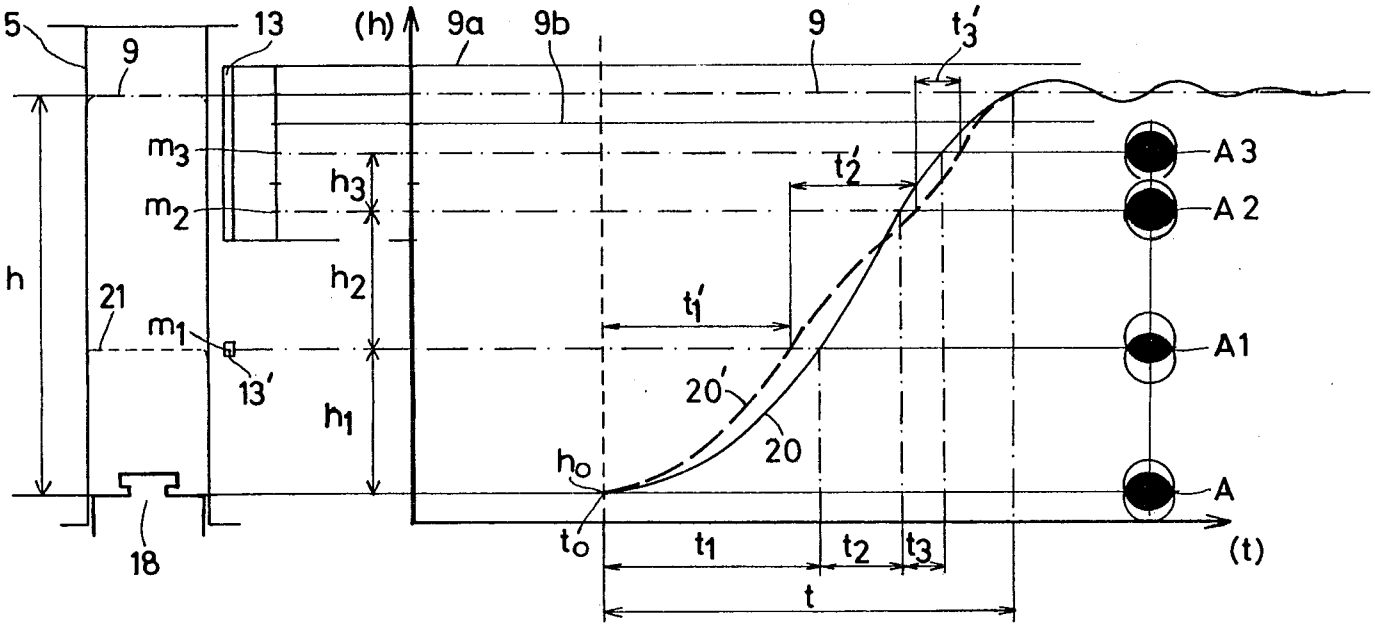
FIG. 3 is a time-dependent start-of-casting graph with corresponding stopper positions.

In FIG. 2, the casting mold 5, in which a variant is shown with only one sensor 13, is readied for the start of casting and is therefore provided with a starting rod 18 forming the bottom of the empty mold 5, which, prior to accepting the normal casting operation in a start-of-casting process, is filled with melt over the metal level 19 up to the desired metal level 9 (See FIG. 3). The start-of-casting is effected with at least one partly filled tundish 1 and, as is apparent from FIG. 3, in accordance with a stored start-of-casting curve 20 along which processor 15 controls the filling of mold 5 with molten metal while taking account of a stored characteristic time t for metal level h.

After the manual triggering of the start of casting, processor 15 opens sliding gate valve 3, e.g., to 75% of the full opening cross section shown in A of FIG. 3. The stream of metal now flows into mold 5, during which the metal level rising over the metal level h passes in succession the measuring points m1, m2, m3 of sensors 13 and 13' shown in FIG. 1, to which are assigned the partial characteristic times t1, t2, t3 fixed within the characteristic time t. The partial real times t' needed for the rise of the actual metal level 21 through filling distances h1, h2, h3 are measured at measuring points m1, m2, m3 and compared with the partial characteristic times t1, t2, t3. If all the measured partial real times t' correspond to the partial characteristic times t, then mold 5 is filled without controlling the movement of sliding gate valve 3. The start-of-casting curve 20 runs as programmed and goes over, after previously switching on strand-pulling mechanism 10, e.g., at level m2, into a desired metal level 9, which occurs between an upper control limit 9*a* and a lower control limit 9*b*.

On the other hand, if there are discrepancies, another automatic comparison is effected of the differing partial real time t1' or t2' or t3' with time ranges preassigned in processor 15, each of which is bound to a specific flow position An of the sliding gate valve 3, which itself is set automatically in accordance with the time range into which falls the partial real time t1' or t2' or t3' measured in each case. For example, for a fixed partial characteristic time t1 or t2 or t3 lasting two seconds, the following n-time ranges in parentheses can be provided: (<1 sec), (1–1.5 sec), (1.5–2 sec), (2–3 sec) and (>3 sec) with corresponding valve positions An.

Assuming that the actual metal level 21, as apparent from the start-of-casting curve 20 shown by the broken line in FIG. 3, covers the filling distance from h1 to measuring point m1 in a shorter partial real time t1' (e.g., 1.7 seconds) than the partial characteristic time t1 (e.g., 2 seconds), then the time range (1.5 to 2 sec), which is compared with t1', produces a new flow position A1 for sliding gate valve 3, which is less than A. In this way, the pouring stream is throttled and the further rise of the actual metal level 21 is slowed down at measuring point m2 where, conversely, the comparison of t2' with t2 requires sliding gate valve 3 to open to flow position A2, due to the fact that the actual metal level 21 rises too slowly over filling distance h2. Finally, the comparison at measuring point m3 of t3' with t3 requires a further slight opening of the sliding gate valve 3 corresponding to position A3 in order to control the passing of the start-of-casting to the actual metal-level control 9 in the preassigned characteristic time t.

As is apparent from FIG. 3, measuring points m2 and m3 and the monitoring unit for the actual metal level 9 between 9*a* and 9*b* are both provided on a single sensor 13 designed as a distance measuring device, while the measuring point m1 is formed as a point. However, in a modification thereof, it is also possible, for example, to provide all the measuring points m1, m2, m3 and the monitoring unit for the desired metal level 9 on a single sensor 13, which extends over a portion of the metal level h, or to install the measuring points m2 and m3 as a point, as at m1. Also, the number of the time ranges chosen for a partial characteristic time t1, t2, etc. may be different from the construction described above, depending on the desired accuracy of the correction to be effected.

When starting the casting of strands of sizes having a small cross section in which each mold 5 usually has only one sensor 13, as shown in FIG. 2, it may be sufficient, due to the very rapid filling time, that only one filling distance of the rising metal level be controlled, for example between the lower end and one-fourth the height of sensor 13.

I claim:

1. A method for the automatic casting start-up for a strand in continuous casting installations, wherein a molten metal flows through a controllable sliding gate valve of a tundish into an empty mold above a starting rod, comprising the steps of: controlling the rising of the actual metal level in the mold along a predetermined start-of-casting curve having predetermined characteristics times between metal-level distances and controlling the level so as to reach a desired metal level with measuring and controlling devices during the pouring operation and causing the strand withdrawal to be commenced; wherein, during the start of casting, beginning with the gate valve being throttled to a start-of-casting position, each partial real time of the rising actual metal level measured within a filling distance is compared with stored time ranges for each of the partial characteristic times, each of the partial characteristic times being assigned a flow position of the gate valve which advances the rising actual metal level in accordance with the predetermined start-of-casting curve, and wherein said gate valve is moved, after the comparison to a corresponding flow position for each time range into which the measured partial real time falls.

2. A method as set forth in claim 1, wherein the predetermined start-of-casting curve is monitored on at least one filling distance.

3. A method as set forth in claim 1, wherein each partial characteristic time corresponding to a filling distance has at least three time ranges with different flow positions of the gate valve.

4. A method as set forth in claim 2, wherein each partial characteristic time corresponding to a filling distance has at least three time ranges with different flow positions of the gate valve.

5. A method as set forth in claim 3, wherein, for a partial characteristic time equal two seconds, five time ranges are provided with gate valve positions corresponding thereto.

6. A method as set forth in claim 4, wherein, for a partial characteristic time equal two seconds, five time ranges are provided with gate valve positions corresponding thereto.

7. A method as set forth in claim 1, wherein the throttled start-of-casting position of the gate valve is between 40 and 90% of the full opening of the gate valve.

8. A method as set forth in claim 2, wherein the throttle-d start-of-casting position of the gate valve is between 40 and 90% of the full opening of the gate valve.

9. A method as set forth in claim 3, wherein the throttled start-of-casting position of the gate valve is between 40 and 90% of the full opening of the gate valve.

10. A method as set forth in claim 4, wherein the throttled start-of-casting position of the gate valve is between 40 and 90% of the full opening of the gate valve.

11. A method as set forth in claim 5, wherein the throttled start-of-casting position of the gate valve is between 40 and 90% of the full opening of the gate valve.

12. A method as set forth in claim 6, wherein the throttled start-of-casting position of the gate valve is between 40 and 90% of the full opening of the gate valve.

13. A method as set forth in claim 1, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

14. A method as set forth in claim 2, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

15. A method as set forth in claim 3, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

16. A method as set forth in claim 4, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

17. A method as set forth in claim 5, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

18. A method as set forth in clam 6, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

19. A method as set forth in claim 7, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

20. A method as set forth in claim 8, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

21. A method as set forth in claim 9, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

22. A method as set forth in claim 10, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

23. A method as set forth in claim 11, wherein time ranges which are smaller than the partial characteristic times are set so as to correspond to flow positions with a smaller opening than that of the start-of-casting flow position, while time ranges which are greater than the partial characteristic times are set so as to correspond to flow positions with an opening which is larger than that of the start-of-casting flow position, the openings being dependent on the amount of deviation between the partial real time and the partial characteristic time.

24. A method as set forth in claim 12, wherein time ranges which are smaller than the partial characteristic times are set so as to correspond to flow positions with a smaller opening than that of the start-of-casting flow positions, while time ranges which are greater than the partial characteristic times are set so as to correspond to flow positions with an opening which is larger than that of the start-of-casting flow position, the openings being dependent on the amount of deviation between the partial real time and the partial characteristic time.

* * * * *